United States Patent [19]

Dusch

[11] Patent Number: 4,550,671

[45] Date of Patent: Nov. 5, 1985

[54] MATERIAL PRESSER DEVICE FOR A SEWING MACHINE

[75] Inventor: Albert Dusch, Kaiserslautern, Fed. Rep. of Germany

[73] Assignee: Pfaff Industriemaschinen GmbH, Fed. Rep. of Germany

[21] Appl. No.: 648,696

[22] Filed: Sep. 7, 1984

[30] Foreign Application Priority Data

Sep. 14, 1983 [DE] Fed. Rep. of Germany ..... 3333046

[51] Int. Cl.[4] ..... D05B 27/04; D05B 29/02

[52] U.S. Cl. ..... 112/235

[58] Field of Search ..... 112/237, 320, 235, DIG. 3

[56] References Cited

U.S. PATENT DOCUMENTS

| | | | |
|---|---|---|---|
| 4,058,071 | 11/1977 | Dunn et al. | 112/235 |
| 4,067,275 | 1/1978 | Willenbacher | 112/320 |
| 4,422,398 | 12/1983 | Dusch | 112/320 |
| 4,487,145 | 12/1984 | Vollmar | 112/320 |

FOREIGN PATENT DOCUMENTS

| | | | |
|---|---|---|---|
| 132044 | 8/1981 | Fed. Rep. of Germany | 112/235 |

*Primary Examiner*—Werner H. Schroeder
*Assistant Examiner*—Andrew M. Falik
*Attorney, Agent, or Firm*—McGlew and Tuttle

[57] ABSTRACT

A material presser device on a sewing machine, includes a presser foot which is attached to a vertically movable presser bar and to which lift movements are imparted by a swing mechanism driven by the main shaft acting through a knee-joint transmission which, in its extended position, extends substantially in the movement direction of the presser bar. For positive connection of the presser foot with the swing mechanism, the presser bar is articulated via an intermediate pitman to one end of the connecting rod of a four-joint transmission. The other end of the four-joint transmission is connected by a connecting rod with an abutment which applies under the action of a spring, against a counter abutment secured to the housing. The connecting rod is connected to the knee joint transmission, the knee joint of which is connected to the sewing machine.

4 Claims, 1 Drawing Figure

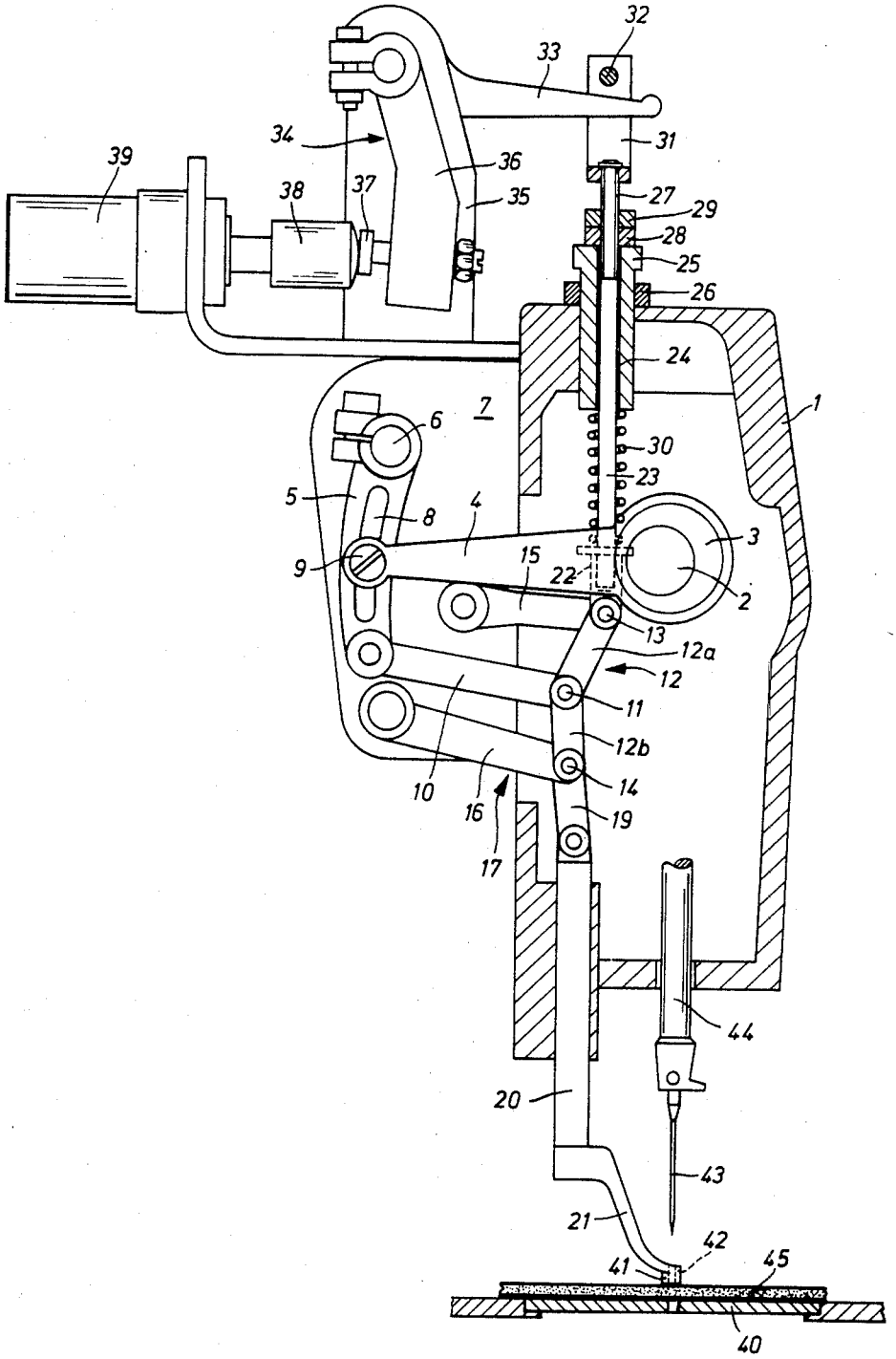
32
33
31
34
36
39
38
37
35
27
29
28
25
26
24
7
1
6
30
23
5
8
4
3
9
15
22
2
13
12a
12
11
12b
14
10
16
19
17
44
20
43
21
42
41
45
40

MATERIAL PRESSER DEVICE FOR A SEWING MACHINE

FIELD AND BACKGROUND OF THE INVENTION

This invention relates in general to sewing machines and in particular to a new and useful material presser device for a sewing machine which includes a transmission connected to a presser foot which engages the material.

In a similar known cloth presser bar device as described in German patent No. PS 31 32 044, U.S. Pat. No. 4,487,145, a gentle setting down of the presser foot is obtained by an idle-stroke connection in the lift drive, in that an angle lever connected with the drive engages from below an abutment surface connected with the presser foot. As the impingement speed of the angle lever on the abutment surface is very slow, the resulting wear and noise are also minimal, but a displacement movement exists between the abutment surfaces, so that wear at this point cannot be avoided entirely due to the strong forces. In addition, tilting occurs under extra-axial pressure onto the bearing of the presser bar.

SUMMARY OF THE INVENTION

The invention provides a drive with improved properties for the vertical movement of the presser foot.

According to the invention the presser bar is articulated through an intermediate pitman to one end of the connecting rod of a four joint transmission, the other end of which is connected with an abutment fast to the housing, and that the connecting rod forms the knee joint transmission, the knee joint of which is connected with the swing mechanism. This eliminates an idle stroke connection within the drive train, and the forces transmitted laterally to the bearing of the presser bar are excluded to a large extent.

An object of the invention is to provide a material presser device for a sewing machine which has a rotatable main shaft which operably drives a reciprocating needle which cooperates with a looper or similar device below a workpiece presser feeding support and which includes a four joint knee joint mechanism connected between a rocking lever driven by the shaft of the sewing machine and a presser foot which engages the material.

A further object of the invention is to provide a workpiece presser which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in a preferred embodiment of the invention is illustrated.

BRIEF DESCRIPTION OF THE DRAWING

The only FIGURE of the drawing is a partial sectional view of a sewing machine having a material presser device constructed in accordance with the invention.

DESCRIPTION OF THE PREFERRED EMBODIMENT

Referring to the drawings in particular the invention embodiment therein comprises a material presser device for a sewing machine having a housing with a rotatable main shaft 2 in the housing which comprises a presser foot bar 20 having a presser foot 21 which is engageable with the material workpiece 45. In accordance with the invention a rocking lever 5 is driven by a bar 4 from an eccentric 3 associated with the main shaft 2. The rocking lever 5 drives through a four joint knee joint generally designated 12 which is connected to the rocking lever and has one joint and connected to the presser bar and an opposite joint end which is connected to a vertically movable rod 23. The rod 23 is mounted for upward and downward movement in a rod bushing 25 which is mounted on the sewing machine housing. Rod bushing 25 forms an abutment which together with another abutment 28 and a lock nut 29 define limits for movement of the rod 23. A spring associated with the rod 25 passes the rod in a direction toward the presser bar 20.

In the housing 1 of the sewing machine, the main shaft 2 is mounted which drives via the eccentric 3 and the eccentric bar 4, the rocking lever 5, which is mounted on a bolt 6 in a bearing shoulder 7 fixed to the housing. The rocking lever 5 has an arcuate slot 8, in which the point of articulation of the eccentric bar 4 can be adjusted by a collar screw 9. Via a substantially horizontal link 10, the free end of the rocking lever 5 is connected with a knee joint 11 of the knee joint transmission 12 formed of two links **12*a* and 12*b*. The two end joints 13 and 14 of the knee joint transmission 12 are connected with a respective rocker 15 and 16 which are both substantially parallel to link 10 and are pivotally mounted on the bearing shoulder 7. The parts 7,12,15 and 16 form together a four joint transmission 17, with the bearing shoulder 7 constituting the ledge and the knee joint transmission 12** the coupling.

The lower end joint 14 of the knee joint transmission 12 is connected via an intermediate pitman 19 with the presser bar 20 which is mounted for vertical displacement in the housing 1 of the sewing machine and carries at its lower end a presser foot 21.

Connected with the upper end joint 13 is a joint bushing 25, into the bore of which the rod 23 is press fitted. The rod 23 passes through the bore 24 of the bushing 25 which is adjustably screwed in the housing 1 and which is fixed in its position by a nut 26. The upper end of rod 23 is provided with thread 27 which has screwed onto it a nut serving the abutment 28 which places itself onto the bushing 25 provided as counter abutment, to limit the lowest position of rod 23. The position of abutment 28 is secured by the lock nut 29. A compression spring 30 on rod 23, which applies against the two bushings 22 and 25, presses rod 23 downwardly.

On the free end of rod 23 a yoke 31 is screwed on, the free ends of which are connected together by a pin 32. Engaging pin 32 from below is an arm 33 of a pivot lever 34 which is mounted on a bearing block 35 fastened on the housing 1. A second arm 36 of the pivot lever 34 carries an adjustable abutment 37 which is in operative connection with a plunger 38 of a compressed air cylinder 39 also secured on the housing 1.

The presser foot 21 comprises a presser sole 41 cooperating with a stitch plate 40 of the sewing machine and provided with a stitch or passage hole 42 for a needle 43. Needle 43 is fastened on a needle bar 44 which is driven by the main shaft 2 in known manner, not shown. It cooperates with a shuttle, also not shown, mounted below the stitch plate 40, to form a seam in the workpiece 45 which lies on the stitch plate 40.

During the sewing, the compressed air cylinder 39 is disconnected. Spring 30 pushes the presser foot 21 onto the work 45 via the bushing 22, along with the knee joint transmission 12 connected therewith, the intermediate pitman 19, and the presser bar 20. With every revolution of the main shaft 2, the eccentric 3 swings the knee joint 11 of transmission 12 back and forth via the connection through the movable eccentric bar 4, rocking lever 5 and the link 10. Due to this movement, the knee joint transmission 12 is flexed in and out, with the result that the presser foot 21 is lowered through the presser bar 20. The screwed position of bushing 25 in housing 1 is adjusted so that just before needle 43 penetrates into the stitch hole 42 in the presser foot 21, the sole 41 thereof sets down on the work 45 under the pressure of spring 30 and abutment 28 lifts off bushing 25. Together with the shuttle, not shown, needle 43 executes a stitch formation and in so doing is moved upward again. As soon as the tip of needle 43 has left the stitch hole 42, the eccentric 3 causes re-engagement of the knee joint 11 through the described connection, whereupon abutment 28 sets down on bushing 25. With the further flexing out of the knee joint transmission 12, the presser foot 21 is raised. Displacement of the work 45 is then possible until the next sewing cycle begins.

When the knee joint transmission 12 is in the area of its extended position, the intermediate pitman 19 is moved very slowly at first as the knee joint transmission 12 flexes in the lower portion of its stroke, but then with increasing speed, in the upper portion portion of its stroke, and conversely is moved downwardly quickly at first and move slowly thereafter, so that the presser foot 21 sets down gently on work 45.

It is possible to adapt the basic position of the presser foot 21 to the thickness of the work 45 by adjusting the relative position of the presser bar 20 by rotation and subsequent fixing of the adjusted position of bushing 25 and/or abutment 28.

To raise the presser foot 21, the compressed air cylinder 39 is pressurized at the end of the sewing operation. Its plunger 38 will then pivot the pivot lever and the arm 33 to move the yoke 31 upward causing the yoke 31 to lift the presser foot 21 off the workpiece 45 by moving the bar 23 and the knee joint transmission 12, intermediate pitman 19 and presser bar 20.

While a specific embodiment of the invention has been shown and described in detail to illustrate the application of the principles of the invention, it will be understood that the invention may be embodied otherwise without departing from such principles.

What is claimed is:

1. A material presser device for a sewing machine having a rotatable main shaft operably driving a reciprocatable needle, comprising a presser bar having a presser foot engageable with the material workpiece, a rocking lever driven by the shaft, a four joint knee-joint connected to said rocking lever and having one joint end connected to said presser and an opposite joint end, a rod bushing mounted on the sewing machine adjacent said rocking lever, and having an abutment adjacent one end, a rod slidably mounted in said bushing having one end connected to said opposite knee joint end, said rod having a further abutment engageable with said abutment of said bushing for stopping motion of said rod at a selected position toward said presser bar, and spring means biasing said rod toward said presser bar.

2. A material presser device according to claim 1, including a rocker link interconnecting said rocking lever in said knee joint between said one joint end and said opposite joint end, a first rocker member pivotally mounted on the sewing machine and connected to said one joint end and extending substantially parallel to said link and a second rocking lever pivotally mounted on the sewing machine adjacent said rocking link and connected at its outer end to said knee joint between the knee joint located between said opposite joint end and the connection of said link to said knee joint.

3. A material presser device according to claim 1, wherein said rod has a yoke portion movable toward and away from the abutment of said bushing during movement of said rod.

4. A material presser device according to claim 3, including a lever member having one arm portion engageable with said yoke of said rod and an opposite arm portion, and an air compression cylinder adjacent said lever arm portion having a piston movable therein engageable with said arm lever portion for moving said arm lever to raise said rod to effect lifting of said presser foot.

* * * * *